US006510627B1

(12) United States Patent
Liu

(10) Patent No.: US 6,510,627 B1
(45) Date of Patent: Jan. 28, 2003

(54) SHOE HAVING A SHOE LACE DEVICE THAT CAN BE TIGHTENED TO SIMULATE A DOUBLE-BOW KNOT

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 0 days.

(21) Appl. No.: 09/920,948

(22) Filed: Aug. 3, 2001

(51) Int. Cl.[7] ..... A43C 1/00
(52) U.S. Cl. ..... 36/50.1; 24/712.5; 24/115 G
(58) Field of Search ..... 36/50.1, 136, 1; 24/712, 712.1, 712.5, 713.2, 714.6, 115 G

(56) References Cited

U.S. PATENT DOCUMENTS 2,893,090 A * 7/1959 Pagoda ..... 24/132 AA
3,080,867 A * 3/1963 Eichinger ..... 24/115 G
3,845,575 A * 11/1974 Boden ..... 24/115 M
4,393,550 A * 7/1983 Yang et al. ..... 24/115 G
4,458,373 A * 7/1984 Maslow ..... 12/142 LC
4,967,454 A * 11/1990 Elieff ..... 24/712.1
5,293,675 A * 3/1994 Shai ..... 24/712.1
6,178,606 B1 * 1/2001 Glendon ..... 24/115 G

* cited by examiner

*Primary Examiner*—M. D. Patterson
(74) *Attorney, Agent, or Firm*—Foley & Lardner

(57) ABSTRACT

A shoe includes a shoe body and a shoe lace device. The shoe body has a pair of eyelet tabs. The shoe lace device includes first, second, third, fourth, fifth and sixth lace sections, and a clamp member. Lower ends of the first to sixth lace sections are anchored on the eyelet tabs of the shoe body. The upper ends of the first and second lace sections, and those of the fourth and fifth lace sections, are interconnected to form first and second loops, respectively. The upper ends of the third and sixth lace sections serve as free lace sections. The clamp member is sleeved slidably on medial portions of the lace sections. Downward and upward movements of the clamp member along the lace sections permit the tightening and loosening of the shoe body.

7 Claims, 9 Drawing Sheets

SHOE HAVING A SHOE LACE DEVICE THAT CAN BE TIGHTENED TO SIMULATE A DOUBLE-BOW KNOT

BACKGROUND OF THE INVENTION

1. Field of the Invention

The invention relates to a shoe, more particularly to a shoe having a shoe lace device that can be tightened to simulate a double-bow knot.

2. Description of the Related Art

Referring to FIG. 1, a conventional shoe 4 comprises a shoe body 41 and a shoe lace device 1. The shoe body 41 has a pair of eyelet tabs 5. The shoe lace device 1 includes a shoe lace 2 having first and second lace sections 201, 202, and a clamp member 3. The first lace section 201 is strung on the shoe body 41 so as to form a criss-cross pattern on the eyelet tabs 5. The second lace section 202 is formed as a simple loop, and has lower ends 2021 connected to the first lace section 201, thereby anchoring the lower ends 2021 on the eyelet tabs 5, respectively. The clamp member 3, as shown in FIG. 2, includes an elongate casing 301, a clamping block 302, and a spring member 303. The elongate casing 301 is formed with a lateral open end 3010 for receiving the clamping block 302, a closed end 3011 opposite to the open end 3010, and a vertically extending hole unit 301' for extension of the lower ends 2021 of the second lace section 202 therethrough. The clamping block 302 is slidably received in the open end 3010 of the casing 301, and is formed with a vertically extending slot unit 3021 that corresponds to the hole unit 301' of the casing 301 for extension of the lower ends 2021 of the second lace section 202 therethrough. The spring member 303 is disposed in the casing 301, and has opposite ends that abut respectively against the clamping block 302 and the closed end 3011 of the casing 301. As such, the clamping block 302 is biased by the spring member 303 so as to misalign the slot unit 3021 from the hole unit 301' in order to clamp the second lace section 202 between the clamping block 302 and the casing 301.

To tighten the shoe 4, the clamping block 302 is operated to compress the spring member 303, and align the slot unit 3021 with the hole unit 301'. The clamp member 3 is then moved downwardly along the second lace section 202, thereby bringing the lower ends 2021 of the second lace section 202 closer together.

To loosen the shoe 4, the clamping block 302 is once again operated to align the slot unit 3021 with the hole unit 301', and the clamp member 3 is then moved upwardly along the second lace section 202, thus permitting the lower ends 2021 of the second lace section 202 to move away from each.

Although the aforesaid shoe 4 has a shoe lace device 1 that is easy to use, the simple loop configuration of the second lace section 202 has an unattractive appearance.

SUMMARY OF THE INVENTION

Therefore, the main object of the present invention is to provide a shoe having a shoe lace device that can be tightened to simulate a double-bow knot.

Accordingly, a shoe of this invention comprises a shoe body and a shoe lace device. The shoe body has a pair of eyelet tabs. The shoe lace device includes: first, second, third, fourth, fifth and sixth lace sections, each of which has a lower end and an upper end; and a clamp member. The lower ends of the first to sixth lace sections are anchored on the eyelet tabs of the shoe body. The upper ends of the first and second lace sections are interconnected to form a first loop. The upper ends of the fourth and fifth lace sections are interconnected to form a second loop. The upper ends of the third and sixth lace sections serve as free lace sections. The clamp member is sleeved slidably on medial portions of the first to sixth lace sections. Downward movement of the clamp member along the first to sixth lace sections brings the lower ends of the first to sixth lace sections closer together for tightening the shoe body. Upward movement of the clamp member along the first to sixth lace sections permits the lower ends of the first to sixth lace sections to move away from each for loosening the shoe body.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
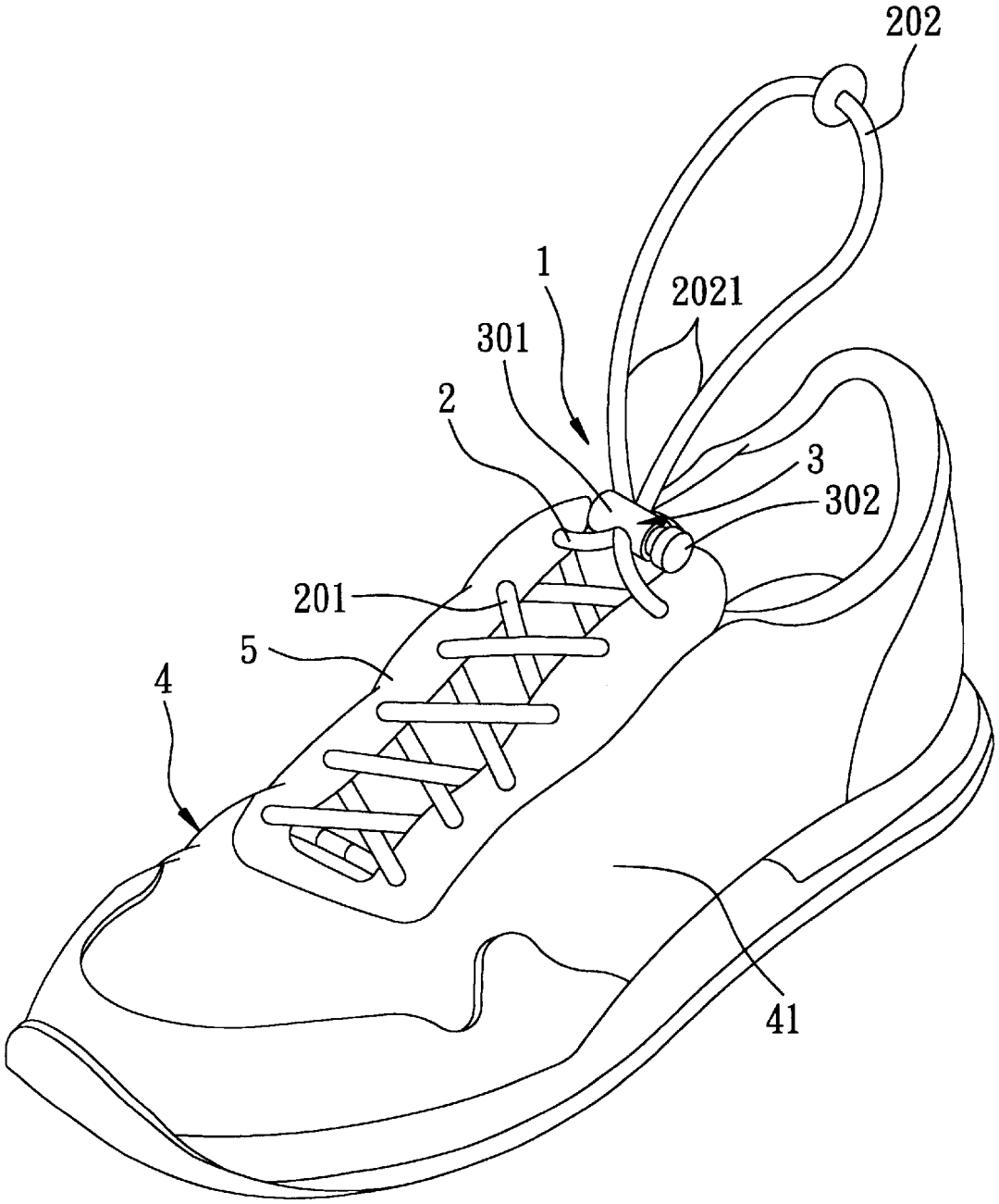
FIG. 1 PRIOR ART
FIG. 1 is a perspective view of a conventional shoe.
Figure 2:
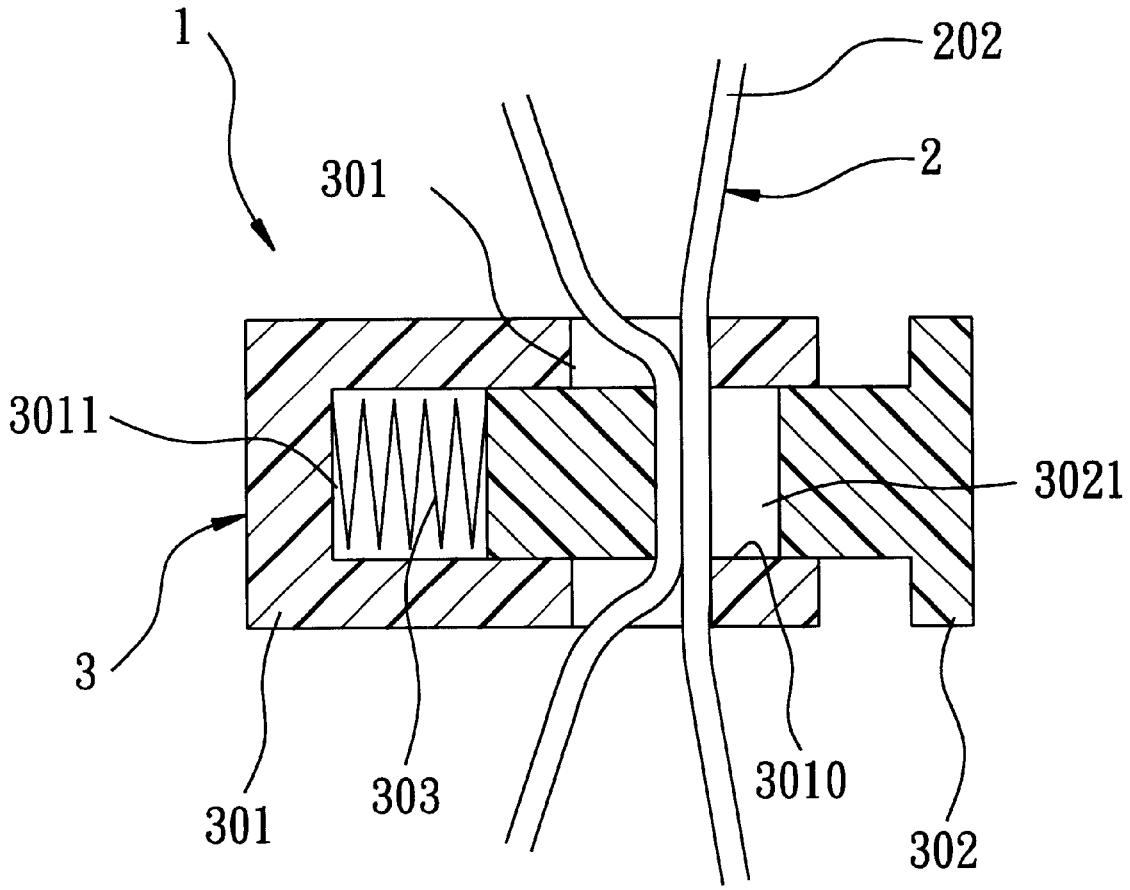
FIG. 2 PRIOR ART
FIG. 2 is a cross-sectional view of a clamp member of a shoe lace device of the conventional shoe.

Before the present invention is described in greater detail, it should be noted that like elements are denoted by the same reference numerals throughout the disclosure.

Figure 3:
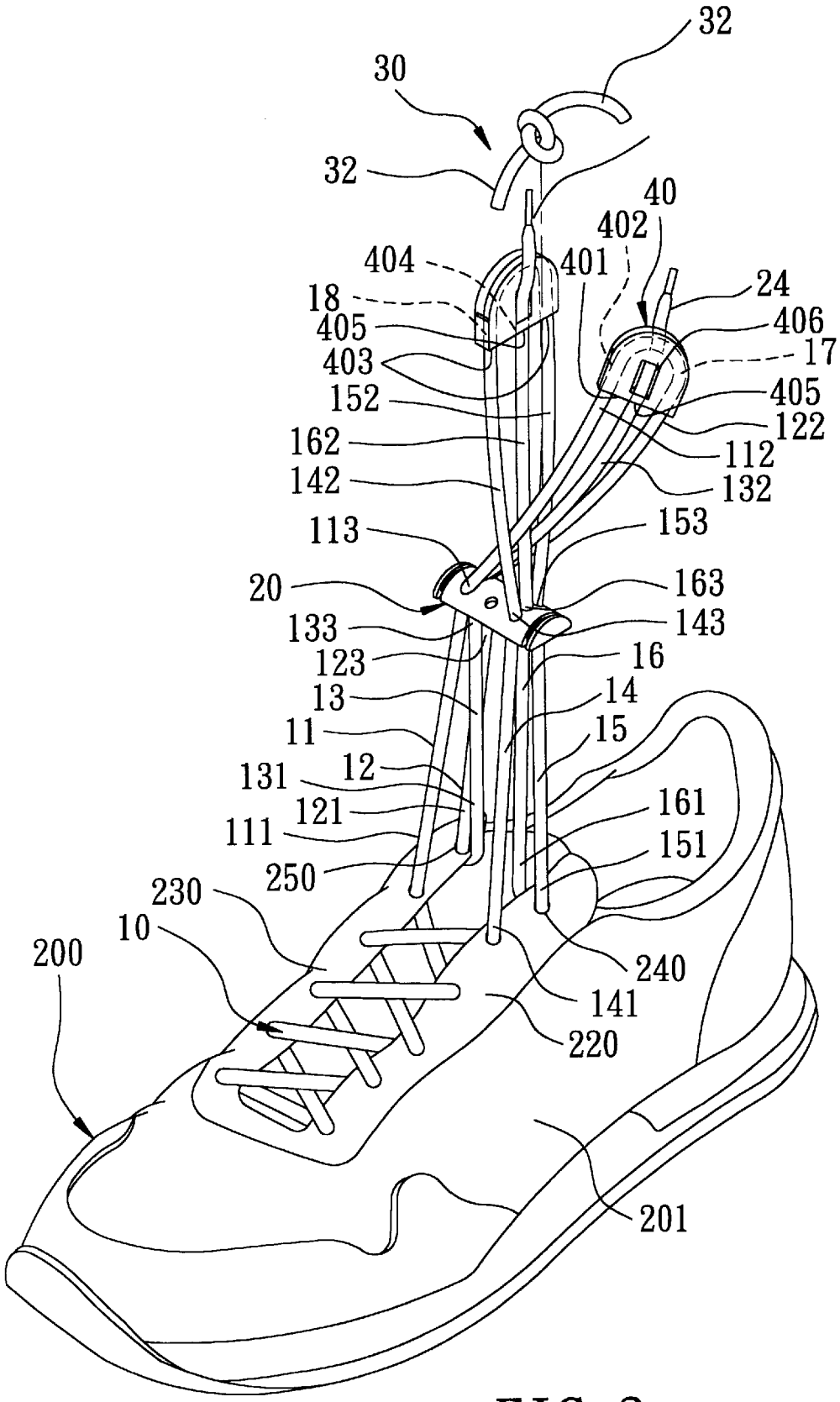
FIG. 3 is a perspective view of the first preferred embodiment of a shoe according to the present invention.

Referring to FIG. 3, the first preferred embodiment of a shoe 200 according to the present invention is shown to comprise a shoe body 201 and a shoe lace device 100. The shoe body 201 has a pair of eyelet tabs 220, 230. The shoe lace device 100 includes a shoe lace 10, a pair of pull plates 40, and a clamp member 20. The shoe lace 10 has a first lace segment that is strung on the shoe body 201 in a conventional manner so as to form a criss-cross pattern on the eyelet tabs 220, 230, and a second lace segment that includes first, second, third, fourth, fifth and sixth lace sections 11, 12, 13, 14, 15, 16, each of which has a lower end and an upper end. The lower ends 111, 121, 131, 141, 151, 161 of the first to sixth lace sections 11, 12, 13, 14, 15, 16 are anchored on the eyelet tabs 220, 230 of the shoe body 201 in a manner to be described hereinafter. The upper ends 112, 122 of the first and second lace sections 11, 12 are interconnected to form a first loop 17. The upper ends 142, 152 of the fourth and fifth lace sections 14, 15 are interconnected to form a second loop 18. The upper ends 132, 162 of the third and sixth lace sections 13, 16 serve as free lace sections 24, 25. Furthermore, the upper ends 112, 122, 132 of the first, second and third lace sections 11, 12, 13 are interleaved with the upper ends 142, 152, 162 of the fourth, fifth and sixth lace sections 14, 15, 16.

Each of the pull plates 40 is connected to the upper ends 112, 122, 132, 142, 152, 162 of a respective set of the first, second and third lace sections 11, 12, 13, and the fourth, fifth and sixth lace sections 14, 15, 16, and has an end wall 401. Each of the end walls 401 is formed with a U-shaped first passage 402 with two first openings 403 formed in the end wall 401, a second passage 404 with a second opening 405 formed in the endwall 401 and disposed between the first openings 403, and an access hole 406 communicated with the second passage 404. The upper ends 112, 122, 142, 152 of the respective set of the first and second lace sections 11, 12 and the fourth and fifth lace sections 14, 15 extend into the first passage 402 via the first openings 403. The upper end 132, 162 of the respective one of the third and sixth lace sections 13, 16 extends into the second passage 404 via the second opening 405 and through the access hole 406.

Figure 4:
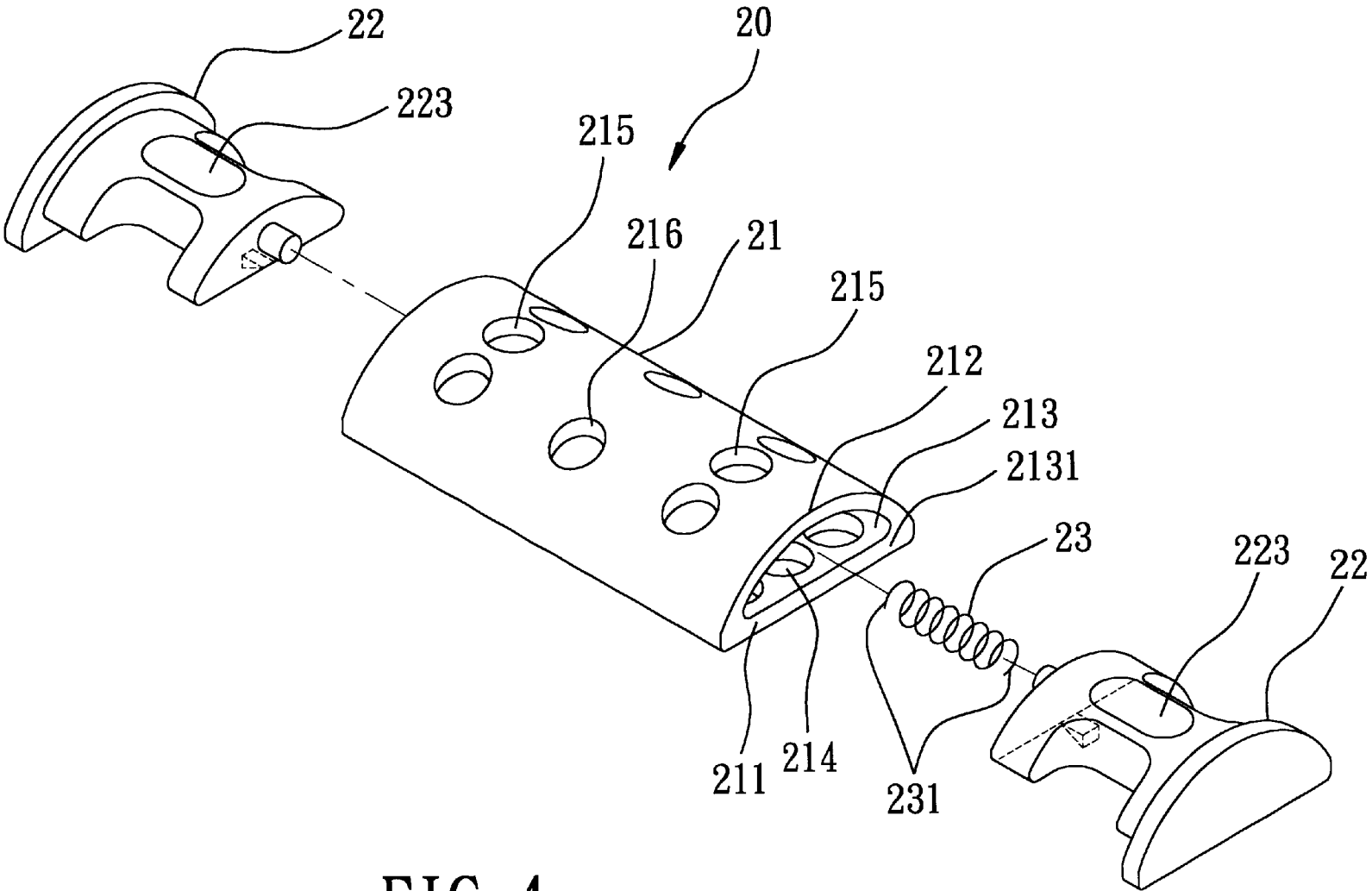
FIG. 4 is an exploded perspective view of a clamp member of a shoe lace device of the shoe according to the present invention.
Figure 6:
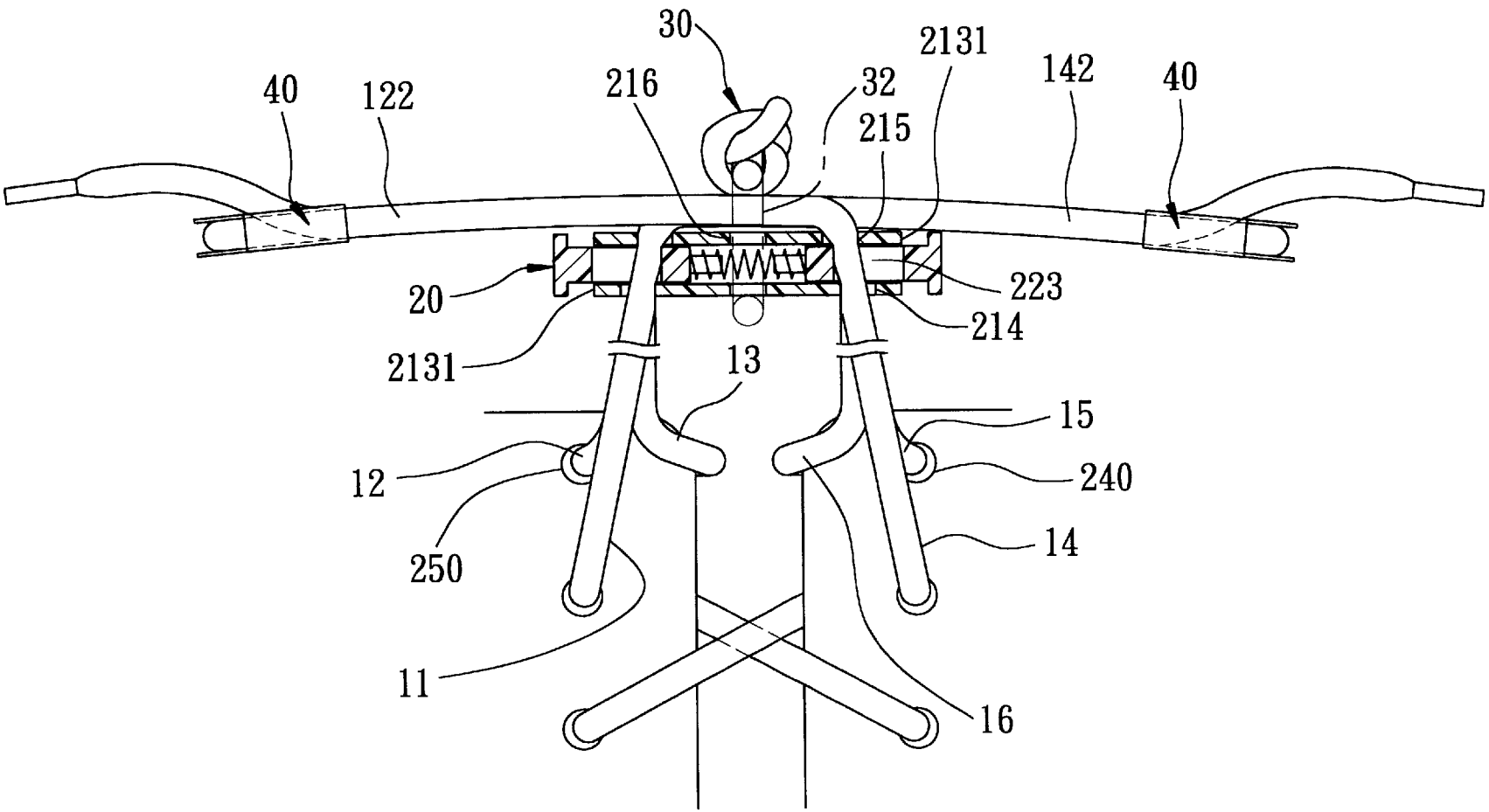
FIG. 6 is a fragmentary cross sectional view illustrating how the lower ends of the lace sections are clamped by the clamp member to tighten the shoe.

The clamp member 20 is sleeved slidably on medial portions 113, 123, 133, 143, 153, 163 of the first to sixth lace sections 11, 12, 13, 14, 15, 16. As shown in FIG. 4, the clamp member 20 includes an elongate casing 21, a pair of clamping blocks 22, and a biasing member 23. The elongate casing 21 has opposite lateral open end portions 213 that are spaced apart from each other in a first direction. Each of the open end portions 213 of the casing 21 has an end face 2131, and is formed with three vertically extending hole units 214, 215 that are arranged in a second direction transverse to the first direction and that permit extension of the medial portions 113, 123, 133, 143, 153, 163 of a respective set of the first, second and third lace sections 11, 12, 13, and the fourth, fifth and sixth lace sections 14, 15, 16 therethrough. The casing 21 includes a lower base plate 211, and a curved upper cover plate 212 connected to the lower base plate 211. Each of the hole units 215, 214 includes an upper hole part 215 formed in the upper cover plate 212, and a lower hole part 214 formed in the lower base plate 211. The lower hole part 214 is disposed closer to the end face 2131 of the respective one of the open end portions 213 than the upper hole part 215, as best illustrated in FIG. 6. Moreover, two vertically extending holes 216 are formed between the open end portions 213 of the casing 21.

The clamping blocks 22 are slidably and respectively received in the open end portions 213 of the casing 21, and are each formed with three vertically extending slot units 223 that correspond respectively to the three hole units 214, 215 in the respective one of the open end portions 213 of the casing 21 for extension of the medial portions 113, 123, 133, 143, 153, 163 of the respective set of the first, second and third lace sections 11, 12, 13, and the fourth, fifth and sixth lace sections 14, 15, 16.

Figure 5:
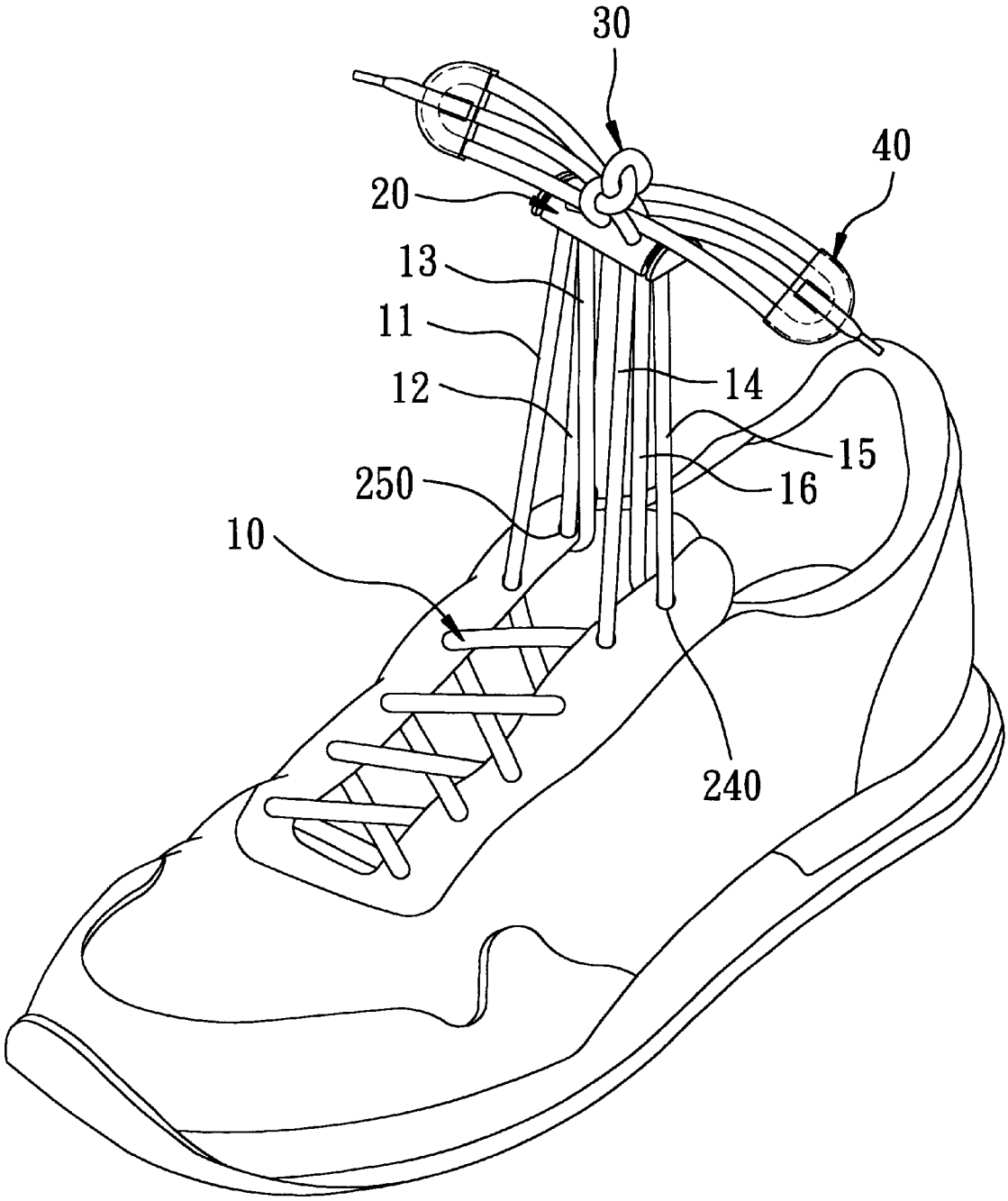
FIG. 5 is a perspective view illustrating how upward movement of the clamp member permits lower ends of lace sections to move away from each so as to loosen the shoe.
Figure 7:
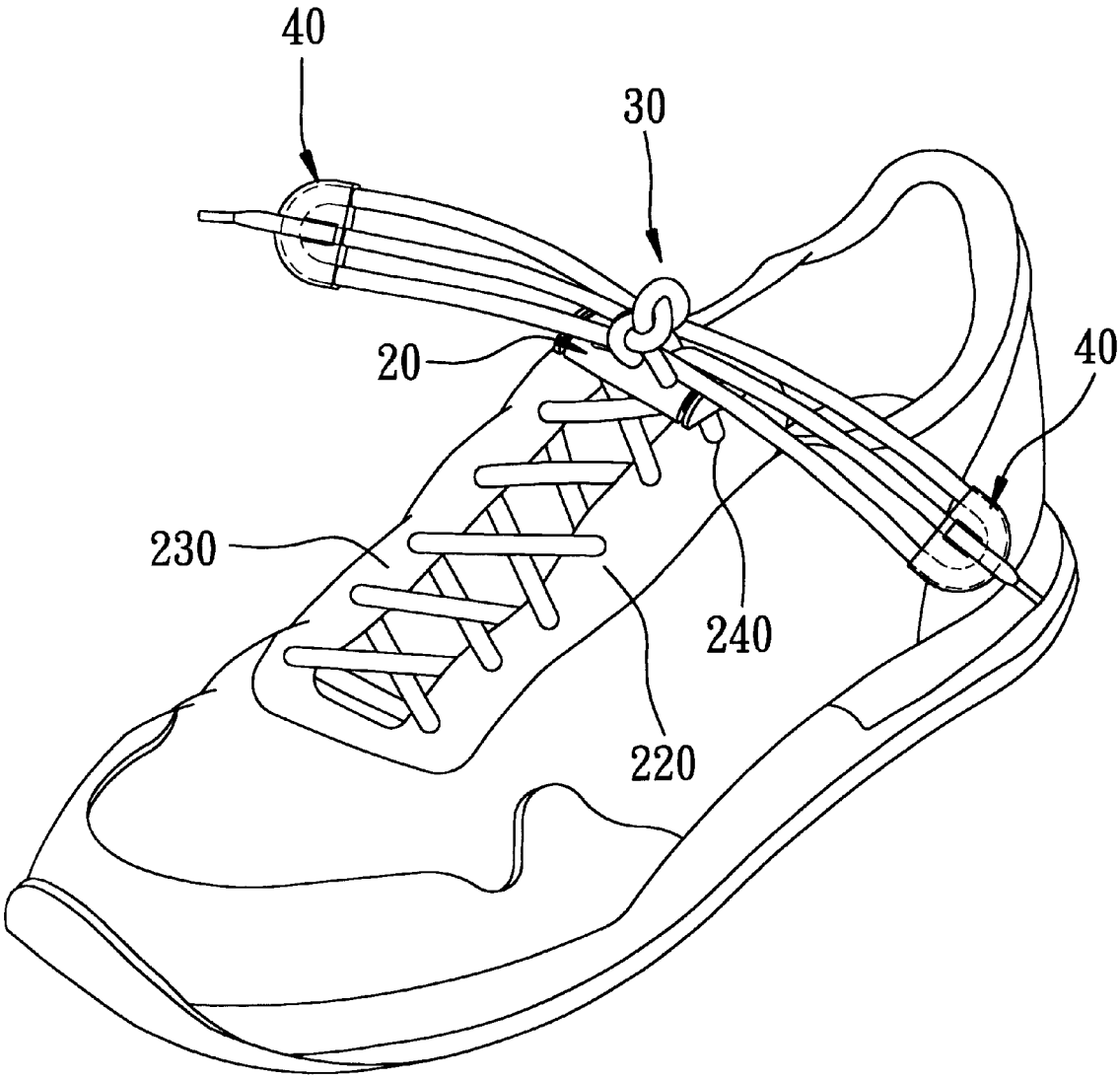
FIG. 7 is a perspective view showing how the shoe body is tightened upon pulling apart a pair of pull plates.

The biasing member 23, in the form of a coil spring, is disposed in the casing 21 and has opposite ends 231 that abut respectively against the clamping blocks 22 for biasing the clamping blocks 22 outwardly of the open end portions 213 of the casing 21. As such, the clamping blocks 22 are biased by the biasing member 23 so as to misalign the slot units 223 from the hole units 214, 215 in order to clamp the medial portions 113, 123, 133, 143, 153, 163 of the first to sixth lace sections 11, 12, 13, 14, 15, 16 between the clamping blocks 22 and the casing 21. Downward movement of the clamp member along the first to sixth lace sections 11, 12, 13, 14, 15, 16 brings the lower ends 111, 121, 131, 141, 151, 161 of the first to sixth lace sections 11, 12, 13, 14, 15, 16 closer together for tightening the shoe body 201, as shown in FIG. 7. Upward movement of the clamp member 20 along the first to sixth lace sections 11, 12, 13, 14, 15, 16 permits the lower ends 111, 121, 131, 141, 151, 161 of the first to sixth lace sections 11, 12, 13, 14, 15, 16 to move away from each for loosening the shoe body 201, as shown in FIG. 5.

The shoe lace device 100 further includes a decorative knot 30 that is disposed externally of the casing 21 between the first and second loops 17, 18, and that has opposite ends 32 secured to the casing. 21. In this embodiment, the ends 32 of the knot 30 are inserted into the holes 216 in the casing 21 and are fixed therein by the use of an adhesive. The medial portions 113, 123, 133, 143, 153, 163 of the first to sixth lace sections 11, 12, 13, 14, 15, 16 further extend between the casing 21 and the decorative knot 30.

In use, by pulling apart the pull plates 40, the clamp member 20 will be forced to slide downwardly along the lace sections 11, 12, 13, 14, 15, 16, and the lower ends 111, 121, 131, 141, 151, 161 of the latter will be brought closer together at the same time for tightening the shoe 200. To loosen the shoe 200, the clamping blocks 22 are operated to compress the biasing member 23, thereby aligning the slot units 223 with the hole units 214, 215. At this time, by moving the clamp member 20 upwardly along the lace sections 11, 12, 13, 14, 15, 16, the lower ends 111, 121, 131, 141, 151, 161 of the latter can move away from each for loosening the shoe 200.

Therefore, the shoe 200 is not only easy to wear and remove, but also has an attractive appearance in view of the double-bow configuration of the shoe lace device 100.

In the first preferred embodiment, the lower ends 111, 141 of the first and fourth lace sections 11, 14 are connected to the first lace segment at two of the eyelets 240, 250 in the eyelet tabs 220, 230. The lower ends 121, 131 of the second and third lace sections 12, 13 are connected to each other at another one of the eyelets 250 in the eyelet tab 230. The lower ends 151, 161 of the fifth and sixth lace sections 15, 16 are connected to each other at another one of the eyelets 240 in the eyelet tab 220.

Figure 8:
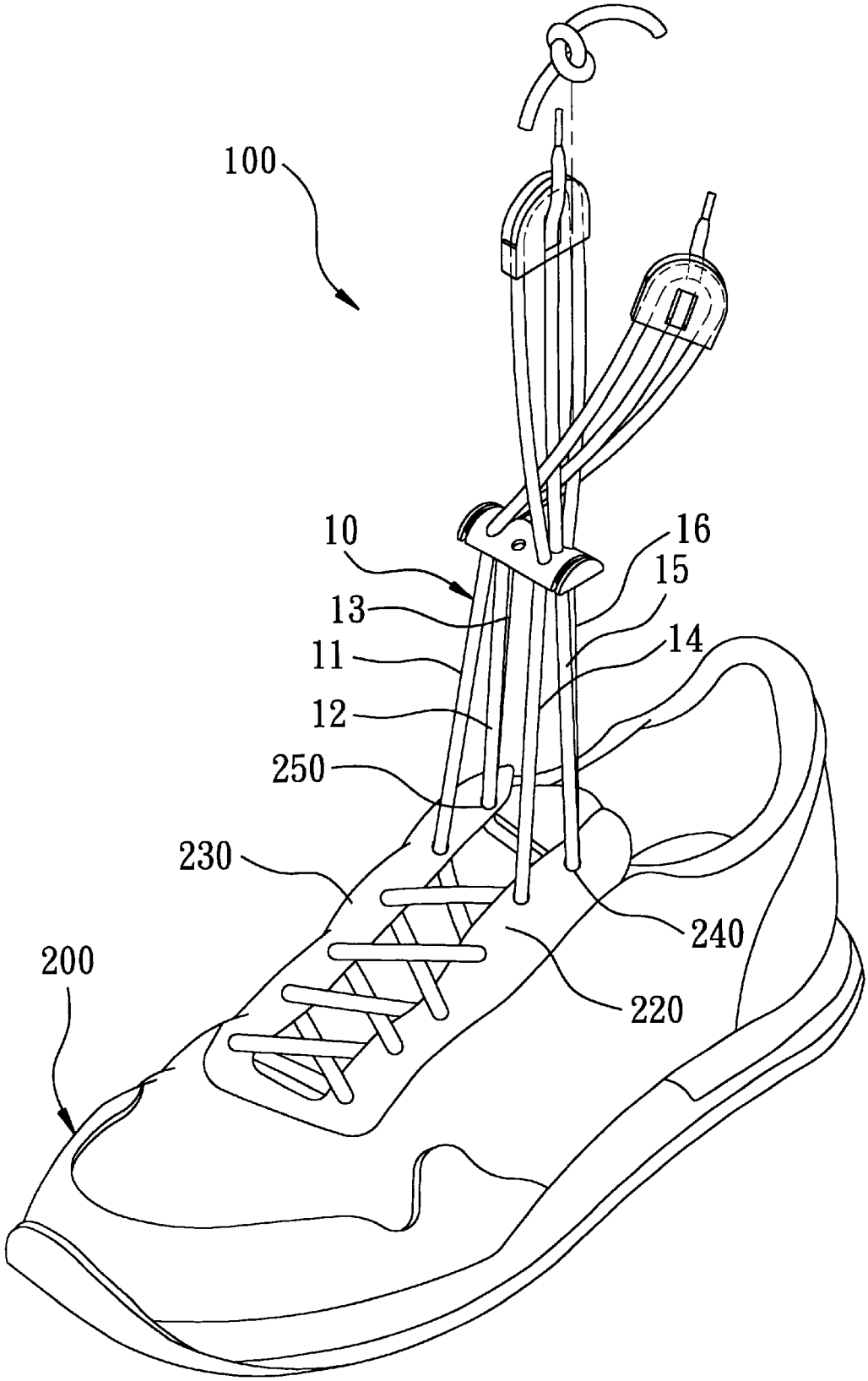
FIG. 8 is a perspective view illustrating the second preferred embodiment of a shoe according to the present invention.

FIG. 8 illustrates the second preferred embodiment of a shoe 200 according to the present invention. Unlike the first preferred embodiment, the lower end 121 of the second lace section 12 extends through an eyelet 250 of the left eyelet tab 230 and crosses to the right eyelet tab 220 to connect with the lower end 161 of the sixth lace section 16. The lower end 151 of the fifth lace section 15 extends through an eyelet 240 of the right eyelet tab 220 and crosses to the left eyelet tab 230 to connect with the lower end 131 of the third lace section 13.

The shoe 200 of the second preferred embodiment operates in a manner substantially similar to that of the first preferred embodiment. In this embodiment, the shoe lace device can be effectively tightened due to the configuration of the lower ends of the lace sections.

Figure 9:
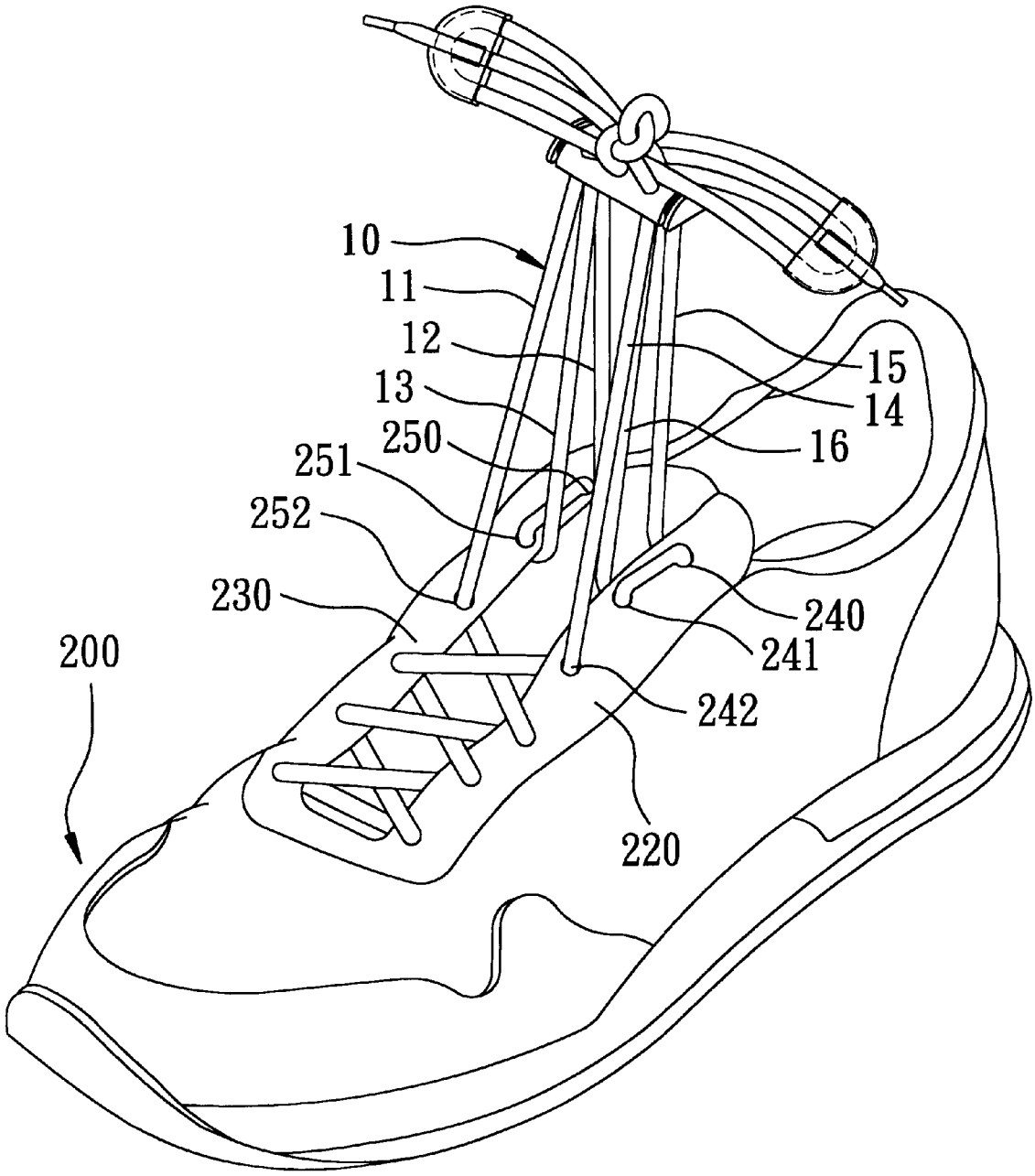
FIG. 9 is a perspective view illustrating the third preferred embodiment of a shoe according to the present invention.

As shown in FIG. 9, the third preferred embodiment of a shoe 200 according to the present invention is shown to be substantially similar to the previous embodiments.

However, unlike the previous embodiments, the lower ends of the lace sections 11, 12, 13, 14, 15, 16 are anchored on the shoe 200 at different eyelets 240, 241, 242, 250, 251, 252 of the eyelet tabs 220, 230. In addition, the lower ends 121, 131 of the second and third lace sections 12, 13 and those of the fifth and sixth lace sections 15, 16 are interconnected above the respective eyelet tab 220, 230.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A shoe comprising:

a shoe body having a pair of eyelet tabs; and a shoe lace device including first, second, third, fourth, fifth and sixth lace sections, each of which has a lower end and an upper end, said lower ends of said first to sixth lace sections being anchored on said eyelet tabs of said shoe body, said upper ends of said first and second lace sections being interconnected to form a first loop, said upper ends of said fourth and fifth lace sections being interconnected to form a second loop, said upper ends of said third and sixth lace sections serving as free lace sections, and a clamp member sleeved slidably on medial portions of said first to sixth lace sections, downward movement of said clamp member along said first to sixth lace sections bringing said lower ends of said first to sixth lace sections closer together for tightening said shoe body, upward movement of said clamp member along said first to sixth lace sections permitting said lower ends of said first to sixth lace sections to move away from each for loosening said shoe body.

2. The shoe of claim 1, wherein said shoe lace device further includes a pair of pull plates, each of which is connected to said upper ends of a respective set of said first, second and third lace sections, and said fourth, fifth and sixth lace sections.

3. The shoe of claim 2, wherein each of said pull plates has an end wall, and is formed with a U-shaped first passage with two first openings formed in said end wall, a second passage with a second opening formed in said end wall and disposed between said first openings, and an access hole communicated with said second passage, said upper ends of the respective set of said first and second lace sections and said fourth and fifth lace sections extending into said first passage via said first openings, said upper end of the respective one of said third and sixth lace sections extending into said second passage via said second opening and through said access hole.

4. The shoe of claim 1, wherein said clamp member includes:

an elongate casing with opposite lateral open end portions that are spaced apart from each other in a first direction, each of said open end portions being formed with three vertically extending hole units that are arranged in a second direction transverse to the first direction and that permit extension of said medial portions of a respective set of said first, second and third lace sections, and said fourth, fifth and sixth lace sections therethrough;

a pair of clamping blocks slidably and respectively received in said open end portions of said casing, each of said clamping blocks being formed with three vertically extending slot units that correspond respectively to said three hole units in the respective one of said open end portions of said casing for extension of said medial portions of the respective set of said first, second and third lace sections, and said fourth, fifth and sixth lace sections; and a biasing member disposed in said casing and having opposite ends that abut respectively against said clamping blocks for biasing said clamping blocks outwardly of said open end portions of said casing, thereby clamping said medial portions of said first to sixth lace sections between said clamping blocks and said casing.

5. The shoe of claim 4, wherein each of said open end portions of said casing has an end face, said casing including a lower base plate, and a curved upper cover plate connected to said lower base plate, each of said hole units including an upper hole part formed in said upper cover plate, and a lower hole part formed in said lower base plate, said lower hole part being disposed closer to said end face of the respective one of said open end portions than said upper hole part.

6. The shoe of claim 4, wherein said shoe lace device further includes a decorative knot disposed externally of said casing between said first and second loops and having opposite ends secured to said casing, said medial portions of said first to sixth lace sections further extending between said casing and said decorative knot.

7. The shoe of claim 1, wherein said upper ends of said first, second and third lace sections are interleaved with said upper ends of said fourth, fifth and sixth lace sections.

* * * * *